US005489068A

United States Patent [19]

Vischiani

[11] Patent Number: 5,489,068

[45] Date of Patent: Feb. 6, 1996

[54] WEFT SUPPLIER FOR SHUTTLELESS LOOMS

[76] Inventor: Giuseppe Vischiani, Mezzovico, Switzerland, 6849

[21] Appl. No.: 140,135

[22] PCT Filed: Apr. 23, 1992

[86] PCT No.: PCT/EP92/00900

§ 371 Date: Nov. 3, 1993

§ 102(e) Date: Nov. 3, 1993

[87] PCT Pub. No.: WO92/19524

PCT Pub. Date: Nov. 12, 1992

[30] Foreign Application Priority Data

May 3, 1991 [IT] Italy ..... MI91A1213

[51] Int. Cl.[6] ..... B65H 51/00; D03D 47/36

[52] U.S. Cl. ..... 242/47.01; 139/452

[58] Field of Search ..... 242/47.01, 47.04, 242/47.05, 47.12; 139/452

[56] References Cited

U.S. PATENT DOCUMENTS

| | | | |
|---|---|---|---|
| 2,649,645 | 8/1953 | Cole | 242/47.05 |
| 3,834,635 | 9/1974 | Pfarrwaller | 242/47.01 |
| 4,068,807 | 1/1978 | Jacobssson | 242/47.01 |
| 4,478,375 | 10/1984 | Sarfati et al. | 242/47.01 |
| 4,614,311 | 9/1986 | Kakinaka . | |
| 4,633,917 | 1/1987 | Riboli | 242/47.01 X |
| 4,708,299 | 11/1987 | Sarfati | 242/47.12 X |
| 4,753,274 | 6/1988 | Svaty | 242/47.01 X |
| 4,926,912 | 5/1990 | Zenoni | 242/47.01 X |
| 5,133,388 | 7/1992 | Tholander | 139/452 |

FOREIGN PATENT DOCUMENTS

| | | | |
|---|---|---|---|
| 0049897 | 4/1982 | European Pat. Off. . | |
| 2374244 | 7/1978 | France . | |
| 2701718 | 6/1978 | Germany . | |
| 547881 | 4/1974 | Switzerland . | |
| 1516535 | 10/1989 | U.S.S.R. | 139/452 |

*Primary Examiner*—John M. Jillions
*Assistant Examiner*—Michael R. Mansen
*Attorney, Agent, or Firm*—Millen, White, Zelane & Branigan

[57] ABSTRACT

A weft supplier for shuttleless looms comprises a drum (6) for the yarn reserve put in rotation by a motor (30) through a clutch (2). The yarn is taken up from the reserve and transferred to a passage between the drum (6) and a cylindrical conical body (13) lying at a given distance on the drum outlet end. Said cylindrical-conical body (13) is rotated synchronously and without shiftings in relation to said drum (6) by means of permanent magnets (12, 16) on facing surfaces of said body (13) and drum (6). The drum (6) bears braking bristles (17) that insist on an area of the cylindrical conical body (13).

8 Claims, 2 Drawing Sheets

15
20
15
14
60
24
13
62
17
39
38
12
16
21
19
8
6
29
26
41
42
3A
3B
4
4E
4A
4C
3E
5
7
11
4B
3
2A
25
2
36
39
35
37
40
27
30
1
28

WEFT SUPPLIER FOR SHUTTLELESS LOOMS

FIELD OF THE INVENTION

The present invention concerns a weft supplying device for shuttleless looms.

BACKGROUND OF THE INVENTION

Looms without shuttle have gained more and more ground in the textile field, supplanting, except specific cases, the conventional shuttle looms. Today they account for about 70% of the existing looms and will more and more cover the remaining 30% of the old shuttle looms as the latter will go out of service.

The shuttleless loom, though having an enormously higher productivity, however presents a drawback versus the shuttle loom, since it has to draw the weft yarn from a reel that has diameters varying from 20–25 cm (full reel) to 4–6 cm (empty reel). This involves high differences of unwinding tension (very low with full reel, very high with empty reel). The shuttle loom, taking the weft from a spool (average diameter 2–4 cm) is not affected by these differences. The great productive superiority of the shuttleless loom has aroused the need of finding a device that, when positioned between reel and loom, could cancel the difference of yarn tension between full reel and empty reel, allowing the yarn take-up member of the shuttleless loom to loom insert the weft at a constant tension.

A device is known essentially consisting of a rotary drum with cone ramp at one end and a ring with very fine nickings, angled with respect to the drum axis, at the other end. The drum, while rotating under the control of a motor, takes the yarn from the reel, winds it on itself from the cone section, and thanks to the latter, arranges the yarn in parallel and not superimposed ranks on its cylindrical section. Said yarn then comes out from the front end of the drum, held by a very light ring on which rather stiff nylon threads are inserted to act like a brush (said stiffness varies according to the treated yarn and the insertion speed). The nylon threads, engaging the above described nickings, prevent the ring and the yarn from having a relative movement with respect to the direction of rotation of the drum.

The yarn, stressed in traction by the take-up member of the loom, with a minimal effort lifts the brush hair and inserts itself as weft in the loom. Simultaneously the brush ring prevents the relative movement of the yarn on the drum with consequent entanglement. The length of the yarn reserve on the drum is controlled by a photoelectric cell which acts on the rotation of the drum. In recent years however the speeds of the weft insertion on the shuttleless looms were more and more increased. The first looms inserted, on a length of 3.30 mt, 180–200 wefts per minute corresponding to about 800–880 meters per minute, and this for single-colored looms. If the loom, as in most cases, worked with 2 or 4 colors or with weft mixing, the average speed required to the weft supplier device was to 4 times lower (also according to the nature of the fabric drawing).

Later these parameters changed, and looms 4 and even 5 meters wide were used with 220 to 250 insertions per minute and at the present time even higher. Therefore the speed required today to a weft supplier ranges from a minimum of 880 to 1200 meters per minute and even more. Under these conditions the weft suppliers of first generation were no longer capable to supply such looms in that, at speeds exceeding 500-600 meters per minute, the brush hair on top of the drum rise due to the centrifugal force, no longer assuring the absence of relative movement of the yarn with respect to the drum, thus causing the yarn entanglement.

SUMMARY OF THE INVENTION

The previously discussed serious drawback was solved using weft suppliers of so-called second generation, wherein the drum is kept still, which drum essentially is the same as the one previously described, but without nickings at its end. The yarn, passing through the hollow driving shaft and forming various angles, is conveyed to an element rotating about the cone head of the drum and is wound up thereon following the same principle as for the rotary drum.

The control of the motor speed and the reserve length is performed by means of electronic systems.

This solution allows speeds that meet the loom requirements, but, if compared with the preceding system, though solving the speed problem, presents the following disadvantages:

a) forces the yarn to angled deviations the sum of which, according to the cases, ranges from 150 to 270 degrees, with obvious mistreatment of same;

b) does not always create perfectly parallel reserves, at least with certain kinds of yarn, with consequent jerk for superimposed rings of yarn. This latter drawback was tentatively faced by feeding the yarn turns by way of a screw, however submitting the same to sliding friction;

c) creates considerable mechanical and mostly electronic complications that, specially in the latter case, involve decrease of reliability, due to a large number of components.

An object of the present invention is now that of overcoming the above-mentioned limitations and-drawbacks of the weft suppliers for shuttleless looms, both with fixed and with rotary drum, and in particular the drawback of the brush hair rising in the latter ones, thus making them suitable to operate at the high speeds required today.

This object is achieved by means of the invention that concerns a weft supplier for shuttleless looms of the type comprising a drum rotated by a motor that receives, under the control of a detector switching on and off the drum rotations, a reserve of yarn turns which are then unwound to supply a loom, passing through a brake formed by one or more rows of bristles, characterized in that it comprises a cylindrical-conical body coaxial to said drum, rotatably supported by bearings mounted on a projecting arm, a free annular space being defined between said cylindrical-conical body and the winding drum to allow a yarn passage towards the loom; in that the drum bears one or more rows of bristles radially extending towards the outside in said annular passage; and in that means are provided to cause a rotation of the cyclindrical-conical body equal and synchronous with that of the drum.

BRIEF DESCRIPTION OF THE DRAWINGS

The invention will be now described with reference to a preferred but not limiting embodiment, illustrated in the accompanying drawings, wherein.

DETAILED DRAWINGS

Figure 1:
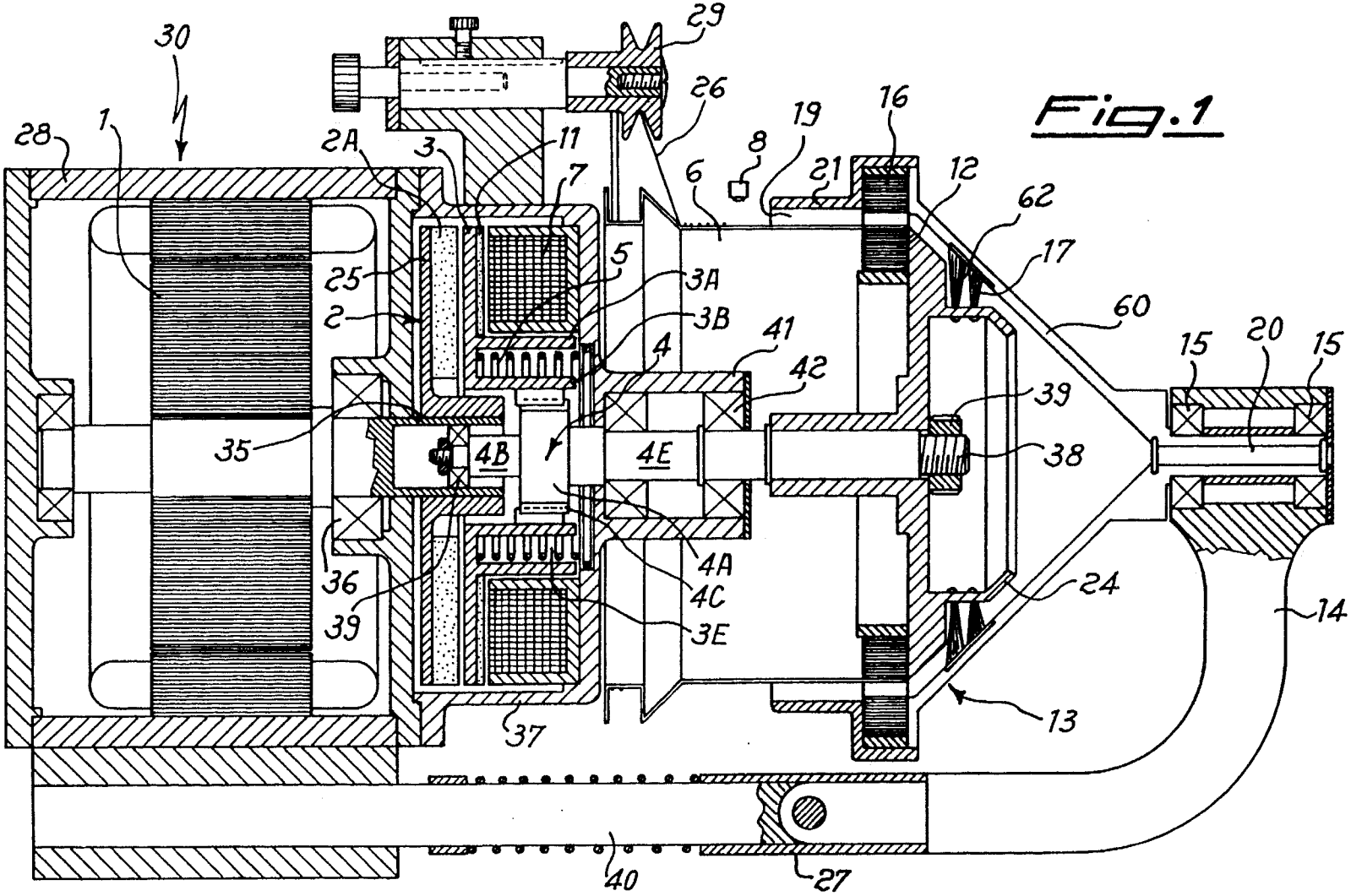
FIG. 1 shows a weft supplier according to the invention in longitudinal section.

With reference to FIG. 1 the weft supplier according to the invention comprises a driving motor 30 and a winding drum 6 that can be rotated by the motor thanks to a friction clutch 2. The rotation of the drum causes the unwinding of the yarn 26 from a reel (not illustrated), through a thread guide 29 fixed to the frame 28 of the motor 30, its winding up on the external surface of the drum 6 and its supply to the loom (not shown) through a tubular duct 20 provided in a cylindrical-conical body 13 that will be more detailedly described hereinafter. The motor 30 comprises a frame 28 and a rotor 1 integral to the driving shaft 35, which is partially hollow and supported by bearings 36. The rotor mass is relatively high if compared to that normally foreseen for this use and the rotor 1 is constantly kept in rotation. The motor therefore is not submitted to switchings on and off as it occurs in the known weft suppliers, with consequent advantages in terms of wear, simplification of electrical controls, regular operation, and so on. This motor can be either of the type at fixed speed or of the type at variable speed.

On the hollow shaft 35 of the motor, as mentioned, a clutch 2 is mounted consisting of a disk 25 and an annular portion 2A made of a material with high friction characteristics. The clutch 2 is capable of transmitting considerable powers. Coaxial to said clutch 2 there is an engaging disk 3 is provided for axially sliding on a grooved shaft 4. The disk 3 is provided with a central flange having two axial parallel walls 3A and 3B that define an annular space 3E. Moreover on the disk 3 another disk 11 is fixed made of good electroconductive material, in particular copper, whose function will be illustrated later on.

The shaft 4 comprises a portion 4B inserted in the hollow shaft 35 and rotatable with respect thereto thanks to the bearing 39, and a portion 4A greater in diameter than the previous one, provided with grooves 4C which engage ribs provided on the internal surface of the flange portion 3B of disk 3. The other end 4E of the shaft is supported by means of bearings 42 mounted on an axial projection 41 of a cap 37 of the clutch and supports the drum 6 of the yarn winding for instance by means of a fastening by screw 38 and nut 39.

The drum 6 is a hollow member, of a substantially cylindrical shape, with a conical portion on which the yarn 26 windings are wound up coming from the thread guide 29, said windings aligning in a certain number on the cylindrical portion to supply then the loom, in a way substantially known per se.

A coil of an electromagnet 7 is positioned around the external wall 3A of the flange 3 and a helicoidal spring 5, properly calibrated, is coaxially positioned in the annular space 3E and abuts against the wall of a cap 37, fixed to the frame 28 of the motor that accomodates all said components.

The action of the spring 5 is such as to push the disk 3 in friction engagement against the disk 2A of the clutch 2, so as to cause the shaft 4 to rotate together with the drum 6 connected therewith, as it will be described hereinafter. The supply of a proper current in the coil of electromagnet 7 causes on the contrary an attraction of the metal disk 3, overcoming the force of spring 5, and the consequent disengagement of the drum 6 from the motor controlling its rotation.

The startup of the electromagnet 7 is controlled by a control module (not shown) as a function of the signals received from a photoelectric cell 8 mounted radially outside the drum and associated with an amplifier. The function of the photoelectric cell is that of "reading" the quantity (in axial direction) of yarn present on the drum, that is the number of reserve turns formed on said drum, disengaging the drum from the motor when the reserve exceeds given limits, so that its decreased speed of rotation determines a taking up of yarn is greater than the quantity arriving from the reel. As it can be better seen later on, the clutch is provided with an electromagnetic brake to slow down the idle rotation of the drum, once disconnected from the motor.

The winding drum 6 has a generally cylindrical configuration and is closed at one end by a shaped portion 24 fixed to the shaft 4E and provided with outer tapering steps. On one of said steps two series of brushes 17 are mounted, for example with nylon bristels, through which the yarn 26A passes directed towards the duct 20 and then to the loom.

A cylindrical-conical body 13 is arranged facing the drum 6 and is supported by an arm 14 projecting from the motor frame 28. Said arm is provided with bearings 15 which support the front portion, of lower diameter, of the body 13, so as to allow its axial rotation. The body 13 has a cylindrical portion 21 of constant diameter, rather prominent, that extends on part of the cylindrical drum, the internal diameter of the cylindrical portion 21 of the body 13 being higher than the external diameter of drum 6, in such a way that the annular space 19 thus formed allows the passage of the thread towards the loom. The two cylindrical portions are connected by a truncated cone element 60, always spaced from the drum portion 24. Furthermore, the cylindrical-conical element is mounted, together with the projecting arm 14, on a second arm 40 fixed to the motor 30 by means of a coupling 27 with return spring which allows the axial displacement and rotation of the body 13 to move it away from the drum 6 and respectively carry it to the shown operative position.

On the inside of the conical portion of the body 13 a metal insert 62 is provided, in the form of a band or strip, on which the ends of the braking brushes 17 press. The weft supplier according to the invention works as follows.

A necessary condition for a correct operation of the weft supplier is that the drum 6 and the cylindrical-conical body 13 turn together at the same speed, instant by instant, though leaving free the passage therebetween. To achieve what above, in the preferred embodiment as illustrated, at the front end of the winding drum 6, in a radially external position, a first series of permanent magnets 12 are mounted, equidistributed and with circumferentially alternate polarities N-S, while in correspondence to an annular seat formed on the cylindrical-conical body a second series of permanent magnets 16 are equidistributed with circumferentially alternate polarities N-S so to radially face the magnets 12 on the drum 6.

The winding drum 6 rotates under the control motor 30 and winds up the yarn 26 coming from a thread guide 29. The cylindrical-conical body 13, thanks to mutual attraction of the magnets 12-16, is driven to turn synchronously with the drum 6, without any sliding, The yarn 26 unwinds from the reserve formed on the drum 6 and passes through the space 19, being only slightly braked by the brushes 17 that press on the insert 25, and comes out from the duct 20 to finally reach the loom (not shown).

The cylindrical portion 21 of the body 13 has the function of preventing the formation of a so-called "ballon" due to a detachment of yarn 26 from the drum 6. Said ballon causes strong overtensions, while, on the contrary, the tension generated by the brushes 17 and the ring 62 of the weft supplier according to the invention is very low.

According to the invention, a particular and effective regulation of the current circulating in the turns of the electromagnet windings 10. In fact a first current level is foreseen, having a fixed value I1, necessary to attract the disk 3 winning the force of spring 5 so as to disconnect the clutch, with possibility of a further gradual increase, manually or automatically controlled according to the need, and eventually modular, up to a maximum value I2 that performs a more rapid braking of the rotation of the disk 3 and therefore of drum 6, exploiting the progressive increase of eddy currents (Foucault's currents) generated in the copper disk 11. This allows to obtain very accurate slowdowns of the winding drum rotation.

Thanks to the proposed device, it has been possible to avoid any sliding between the brushes and the drum as well as any deformation of the brushes themselves, therefore avoiding any uncontrolled movement of the yarn with respect to the drum and without complicated or expensive solutions.

Furthermore, the presence of a motor with high mass always in rotation serves first of all to compensate the higher inertia due to the weight of the rotating permanent magnets, simultaneously avoiding to excessively potentiate or overload the motors at the start because, due to the control of a photoelectric cell, very frequent stops and starts are requested.

Figure 3:
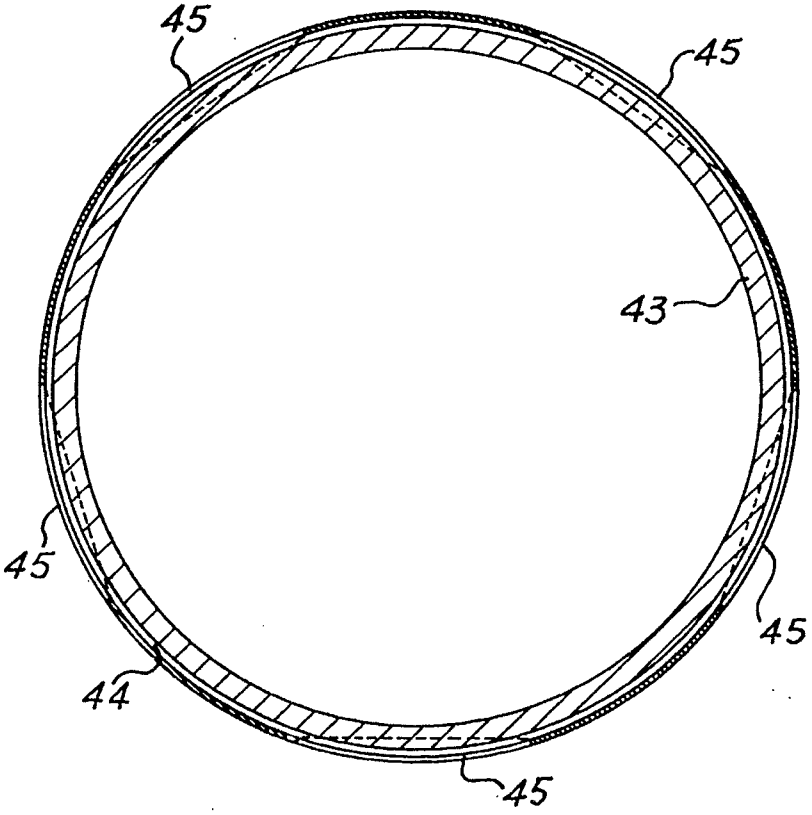
FIG. 3 is a cross section according to the line III—III of FIG. 2.
Figure 2:
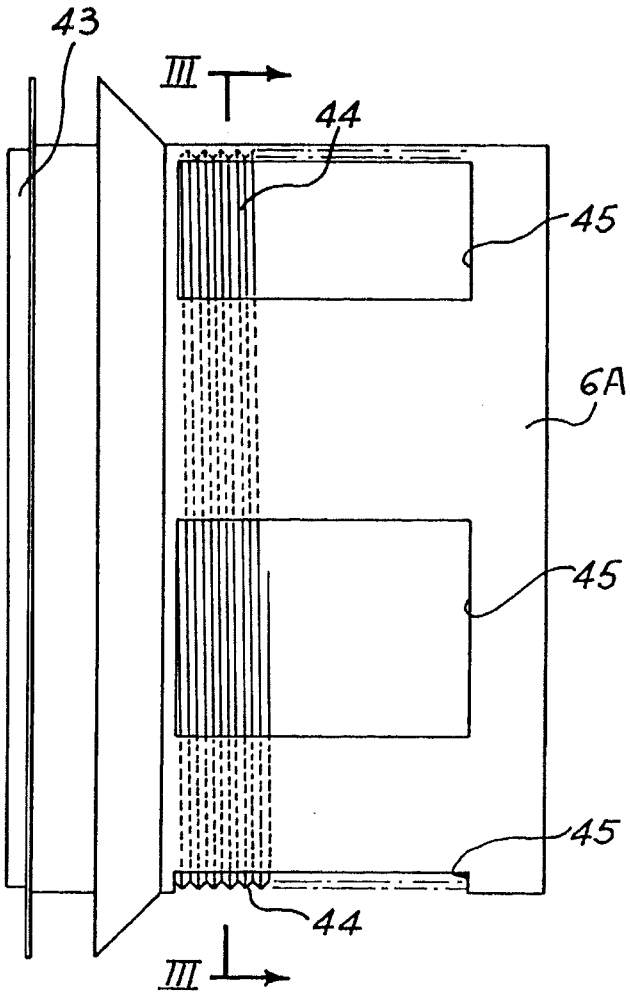
FIG. 2 is a side view of an alternative embodiment of a winding drum of the weft supplier according to the invention.

According to a modified embodiment, the drum 6 has the structure illustrated in FIGS. 2 and 3, wherein the drum 6A accomodates therein a fixed cylindrical body 43, with external surface provided with a threading 44, while the drum 6A is provided on its surface with windows 45 that extend for almost all its length and expose said threading. Thanks to this construction, the turns are housed on the fixed threading, remaining appropriately spaced and positioned, and they are then drawn therefrom through the windows 45, due to the rotation of drum 6. The invention has been illustrated with particular reference to preferred embodiments, but it has not to be considered as limited to what illustrated, since it comprises also changes and modifications that will result evident to those skilled in the art

I claim:

1. A weft supplier for shuttleless looms, including: a drum 16) having a front end rotated by a motor (30) and on which a reserve of yarn turns is wound under the control of a detector (8) for switching on and off the rotations of the drum (6), said yarn turns being then unwound to supply a Icom, passing through a brake formed by one or more rows of bristles, the improvement comprising: a cylindrical-conical body (13) coaxial with said drum (6) and rotatably supported by bearings (15) mounted on a projecting arm (14), a free annular space (19) defined between said cylindrical-conical body having a truncated core portion (13) and the winding drum (6) to allow a yarn passage towards the Icom; the drum (6) being provided with at least one row of bristles (17) extending radially in said annular passage (19) in an outward direction; means provided for causing a rotation of the cylindrical-conical body (13) equal to and synchronous with that of the drum (6); a first series (12) of permanent magnets disposed at the front end of the drum, the permanent magnets being equidistributed on the drum with circumferentially alternate polarities; and a cylindrical portion (21 ) of said cylindrical-conical body (13) carrying a second series (16) of permanent magnets, equidistributed on the cylindrical portion and having circumferentially alternate polarities, the magnets of the two series radially facing each other.

2. A weft supplier according to claim 1, characterized in that said body (13) has a cylindrical portion (21) that extends axially to cover a terminal portion of the drum (6), the internal diameter of said cylindrical portion (21) being greater than the external diameter of the drum (6) so as to define said free annular space (19) for the passage of yarn (26) towards the loom, said body further comprising a truncated cone section and a cylindrical end section, which is supported by said arm (14) and defines a yarn axial path (20) towards the loom.

3. A weft supplier according to claim 2, characterized in that the front end of the drum (6) is closed by a substantially conical portion (24) facing said truncated cone section of the body (13) and bearing one or more rows of bristles or brushes (17), extending as far as a supporting area (25) on the inside of said truncated cone portion of the body (13).

4. A weft supplier according to claim 1, characterized in that said projecting arm (14) comprises a sleeve (27) adapted to be inserted onto a second arm (40) fixed to the frame (28) of motor (30), in order to allow axial and rotational movements of the cylindrical-conical body (13) between a position of access to the drum and an operative position.

5. A weft supplier according to claim 1, characterized in that said motor (30) permanently rotates and in that, between said drum (6) and said motor (30), a clutch (2) is provided for which clutch is controlled by the detector (8) of the reserve of yarn turns.

6. A weft supplier according to claim 5, characterized in that said clutch is of the electromagnetic type, with a disk (3) integral in rotation to the drum (6) and axially movable to engage the friction disk (2A), which is urged by a spring into integral rotation with the motor 30); as well as with an electromagnet, whose excitation attracts the disk (3), encountering the resistance of the spring (5) and disconnecting the clutch.

7. A weft supplier according to claim 6, characterized in that a plate (11) in an electroconductive material is coupled to the disk (3) integral to the drum, and in that means are provided to regulate the current supplied to the electromagnet at values equal and exceeding those necessary to disconnect the clutch.

8. A weft supplier according to claim 1, characterized in that said drum (6) comprises a cylindrical threaded body (43), non-turnably mounted inside the drum (6), wherein the drum is provided with at least one circumferentially positioned opening (45) that allow the yarn to rest on the threading exposed by the surface of the cylindrical body and which draw the yarn from said threading.

* * * * *